US007053856B2

(12) United States Patent
O'Sullivan

(10) Patent No.: US 7,053,856 B2
(45) Date of Patent: May 30, 2006

(54) OMNI-DIRECTIONAL, ORTHOGONALLY PROPAGATING FOLDED LOOP ANTENNA SYSTEM

(75) Inventor: Daniel J. O'Sullivan, Babylon, NY (US)

(73) Assignee: Honeywell International, Inc., Morristown, NJ (US)

( * ) Notice: Subject to any disclaimer, the term of this patent is extended or adjusted under 35 U.S.C. 154(b) by 63 days.

(21) Appl. No.: 10/849,430

(22) Filed: May 19, 2004

(65) Prior Publication Data

US 2005/0259029 A1 Nov. 24, 2005

(51) Int. Cl.
*H01Q 7/00* (2006.01)
*H01Q 11/00* (2006.01)
*H01Q 1/38* (2006.01)

(52) U.S. Cl. ..... 343/866; 343/843; 343/700 MS

(58) Field of Classification Search ..... 343/700 MS, 343/702, 741, 843, 846–849, 866
See application file for complete search history.

(56) References Cited

U.S. PATENT DOCUMENTS 4,477,813 A * 10/1984 Weiss ..... 343/700 MS
4,719,470 A * 1/1988 Munson ..... 343/700 MS
6,404,394 B1 * 6/2002 Hill ..... 343/702
6,774,850 B1 * 8/2004 Chen ..... 343/700 MS
6,801,168 B1 * 10/2004 Yeh ..... 343/700 MS
6,822,610 B1 * 11/2004 Yeh ..... 343/700 MS
6,850,192 B1 * 2/2005 Yeh ..... 343/700 MS
6,853,335 B1 * 2/2005 Yeh ..... 343/700 MS
2004/0070540 A1 * 4/2004 Wang et al. ..... 343/702

* cited by examiner

*Primary Examiner*—Tan Ho
*Assistant Examiner*—Leith Al-Nazer
(74) *Attorney, Agent, or Firm*—Scully, Scott, Murphy & Presser, P.C.

(57) ABSTRACT

The present invention relates to an omni-directional, orthogonally propagating, one-quarter wavelength folded loop antenna. The antenna may be embodied in a wire, flat metal stock or printed configuration. The antenna comprises a folded loop antenna comprising an upper and lower horizontal element with a first and a second end and each of a length that is approximately forty-five percent of the overall one-quarter wavelength of the folded loop antenna connected by a vertical element. The antenna further comprises a ground plane having a minimum vertical length of three-sixteenths of a required wavelength and a horizontal width of a minimum of one-fifth of a wavelength as measured from the physical center of a first end of an antenna feed element. Further aspects of the folded loop antenna system are enabled with polarization diversity and selectable secondary resonance frequency and 10 dB return loss bandwidth.

4 Claims, 4 Drawing Sheets

Azimuth Antenna Pattern 1

Elevation Antenna Pattern 1

Elevation Antenna Pattern 2

Azimuth Antenna Pattern 2

OMNI-DIRECTIONAL, ORTHOGONALLY PROPAGATING FOLDED LOOP ANTENNA SYSTEM

FIELD OF THE INVENTION

The present invention relates to omni-directional antenna devices that can be used most particularly in the field of wireless transmissions.

BACKGROUND OF THE INVENTION

Integrated wireless devices often require communications on more than one band of frequencies. Often, these frequency bands cannot be accommodated by one antenna. The usual solution to this problem is to employ two antennas in order to accommodate multiply frequency bands. However, this solution increases the cost involved in employing the wireless device in addition to increasing the complexity involved in implementing the wireless system.

Therefore, a need exists for a low-cost, high performance omni-directional antenna. Further, the antenna being provided with polarization diversity and the ability to produce a controllable secondary resonance that can support two frequency bands with a single antenna.

SUMMARY OF THE INVENTION

The present invention relates to a low-cost high performance omni-direction antenna. The antenna is provided with polarization diversity, thus allowing the antenna to overcome communication problems that are caused by multipath reflections or naturally occurring polarization rotation. Further, the antenna can be modified in order to produce a controllable secondary resonance that can support two frequency bands within a single antenna.

An embodiment of the present invention comprises an omni-directional, orthogonally propagating, one-quarter wavelength folded loop antenna. The antenna being a folded loop antenna comprising an upper horizontal element with a first and a second end and a length that is approximately forty-five percent of the overall one-quarter wavelength of the folded loop antenna. A ground plane is provided that is in contact with a conductive medium antenna return element, the ground plane having a minimum vertical length of three-sixteenths of a required wavelength and a horizontal width of a minimum of one-fifth of a wavelength as measured from the physical center of a first end of an antenna feed point. The antenna further comprises a vertical element that is in contact with the upper horizontal antenna element, the vertical element serving as an antenna return, wherein the vertical element does not exceed two radiating element line-widths.

An aspect of the above-mentioned embodiment comprises a folded loop antenna that is fabricated from a conductive medium comprising wire, wherein the antenna is of a rectangular parallelepiped shape. The antenna has a length that is approximately one-eighth of a wavelength at a required frequency, a height of approximately three-fourths of an inch and a width of approximately one-fourth of an inch. Further, the antenna comprises a radiating element wire circumference that is one-one hundred and fiftieth of a wavelength.

Another aspect of the above-mentioned embodiment comprises a folded loop antenna that is fabricated from a conductive medium comprising flat metal stock, wherein the antenna element is of a rectangular parallelepiped shape.

The antenna has a length that is approximately one-sixth of a wavelength at a required frequency, a height of approximately one-fourth of an inch and a width of approximately one-fourth of an inch. Further, the antenna comprises a radiating element width that is one-one hundredths of a wavelength.

A yet further aspect of the above-mentioned embodiment comprises a folded loop antenna that is an antenna element printed of a conductive medium, wherein the antenna element is of a significantly rectangular shape. The antenna has a length that is approximately one-sixth of a wavelength at a required frequency and a width of approximately one-fourth of an inch. Further, the antenna comprises a radiating element line-width that is one-one hundred and fiftieth of a wavelength.

A further embodiment of the present invention comprises an omni-directional, orthogonally propagating, one-quarter wavelength folded loop antenna system enabled with polarization diversity. The antenna comprises a folded loop antenna fabricated from a conductive medium, the folded loop antenna comprising an upper horizontal, a lower horizontal and a vertical antenna element, wherein the antenna has an overall length that is approximately one-fourth of a wavelength at a required frequency.

A ground plane is in contact with the folded loop antenna, wherein the ground plane has a minimum length of three-sixteenths of a required wavelength and further comprises a vertical trace that is in contact with the upper horizontal antenna element, the vertical trace serving as an antenna return. A conductive plane is situated in proximity to the folded loop antenna near the antenna feed and antenna return of the folded loop antenna, the conductive plane is electrically isolated from the ground plane and the folded loop antenna. The conductive plane is a minimum of one-half inch wide and has a length that extends the approximate length from the upper horizontal element to the lower horizontal element. A semiconductor device is in electrical contact with the ground plane and the conductive plane. Further, a processing means is in electrical communication with the semiconductor device, wherein the processing means controls the activation and deactivation of the semiconducting device.

A yet further embodiment of the present invention comprises an omni-directional, orthogonally propagating, one-quarter wavelength folded loop antenna enabled with selectable secondary resonance frequency and 10 dB return loss bandwidth. The antenna comprises a printed folded loop antenna that is fabricated from a conductive medium. The printed folded loop antenna has an upper horizontal, lower horizontal, and a vertical antenna element, each element comprising a first and second end. The antenna has an overall length that is approximately one-fourth of a wavelength at a required frequency and a line width of one-one hundred and fiftieth of a wavelength. A ground plane is in contact with the printed folded loop antenna, wherein the ground plane has a minimum length of three-sixteenths of a required wavelength and further comprises a vertical trace that is in contact with the upper horizontal antenna element, the vertical trace serving as an antenna return. The vertical trace does not exceed two radiating elements in width.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment, and wherein.

DETAILED DESCRIPTION

One or more exemplary embodiments of the invention are described below in detail. The disclosed embodiments are intended to be illustrative only since numerous modifications and variations therein will be apparent to those of ordinary skill in the art. In reference to the drawings, like numbers will indicate like parts continuously throughout the views.

Figure 1:
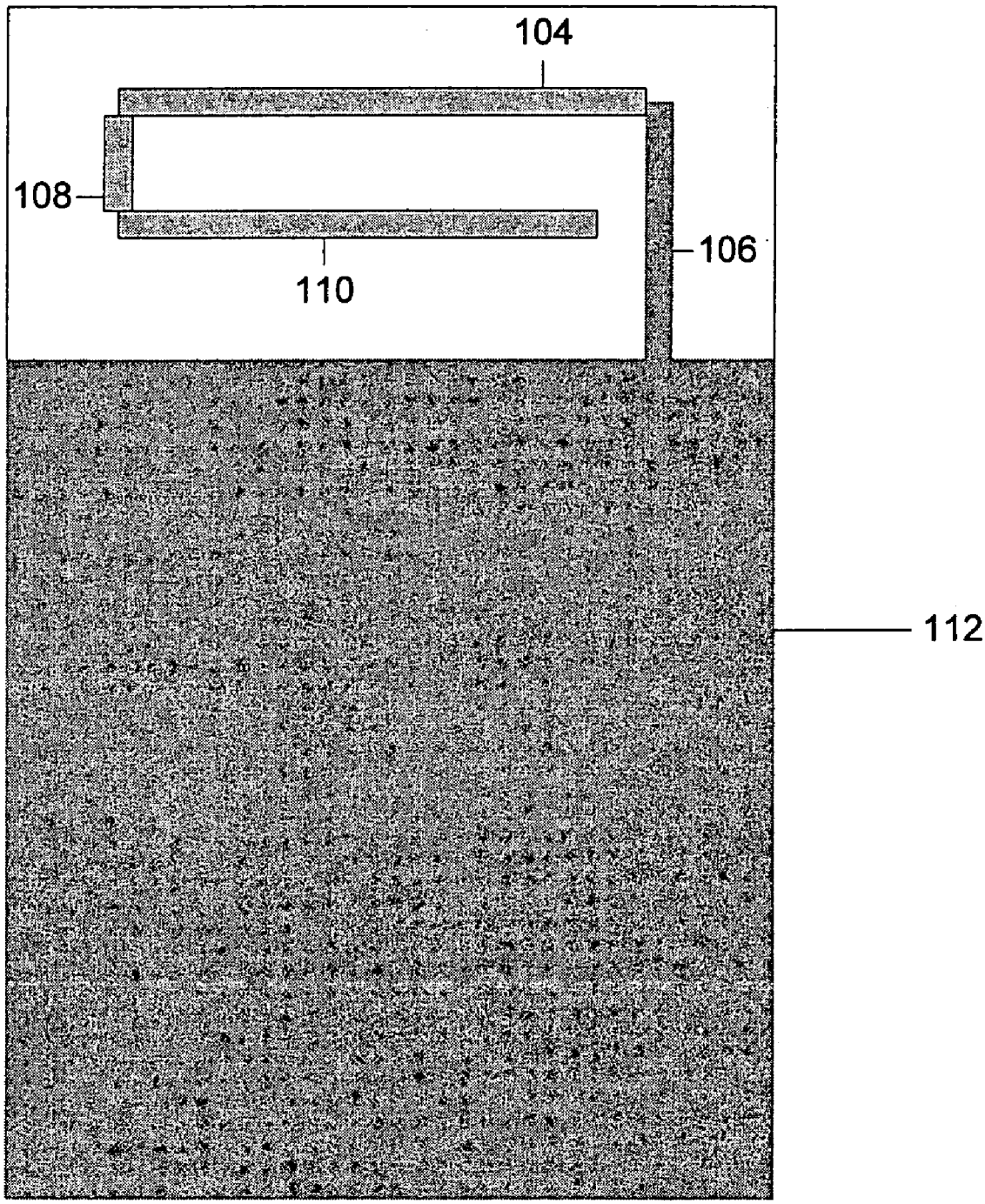
FIG. 1 is a diagram that relates to embodiments of the present invention.

The present invention is initially described in reference to FIG. 1. FIG. 1 illustrates an omni-directional, orthogonally propagating, one-quarter wavelength folded loop antenna, wherein the folded loop antenna comprises an upper horizontal element 104 with a first and a second end and a length that is approximately forty-five percent of the overall one-quarter wavelength of the folded loop antenna.

As illustrated in FIG. 1, the folded loop antenna further comprises a vertical element 108 with a first and a second end, the first end of the vertical element 108 being in contact with the second end of the upper horizontal element 104. The length of the vertical element 108 is the greater of one quarter of an inch or three times the width of the upper horizontal element 104.

The folded loop antenna further comprises a lower horizontal element 110 that is parallel to the upper horizontal element 104. The lower horizontal element 110 has a first and a second end, the first end of the lower horizontal element 110 being in contact with the second end of the vertical element 108. The second end of the lower horizontal element constitutes the antenna feed point.

A ground plane 112 is in contact with a vertical trace 106, the ground plane 112 having a minimum vertical length of three-sixteenths of a required wavelength and a horizontal width of a minimum of one-fifth of a wavelength as measured from the physical center of a first end of an antenna feed element. In all embodiments of the antenna the measurement requirement for the ground-plane remains constant. Yet further, the vertical trace 106 is in contact with the upper horizontal antenna element 104, the vertical trace serving as an antenna return. Further, the vertical trace 106 does not exceed two radiating element line-widths.

Please note that the distance between the ground plane 112 and the folded loop antenna is variable and affects the bandwidth of the antenna. Also, the antenna may be constructed of various materials that are known to those of skill in the art. Further embodiments of the antenna are described below:

Wire Folded Loop Antenna

The wire folded loop embodiment of the folded loop antenna is designed using wire that is cut to a length that is appropriate for a given frequency of interest. Moreover, the overall length of the antenna is approximately one-fourth wavelength at the given frequency. The layout and proximity of the antenna to a ground plane 112 on a printed circuit board is key to the performance of the antenna, wherein minimum ground plane size is critical.

The wire folded loop antenna is of a rectangular parallelepiped shape and having a length that is approximately one-eighth of a wavelength at a required frequency, a height of approximately three-quarters of an inch, a width of approximately one-quarter of an inch and a radiating element wire circumference that is one-one hundred and fiftieth of a wavelength. A first portion of the lower horizontal element 110 serves as the antenna feed point and extends upward at a distance of three quarters of an inch away from a plane of a printed circuit board where the antenna is to be connected, and further, a second portion of the lower horizontal element 110 extends parallel to the plane of the ground plane 112 of a printed circuit board. A third portion of the lower horizontal element 110 extends downward towards the printed circuit board at a distance three quarters of an inch from the second end of the lower horizontal element 110. The vertical element 108 comprises a length that is the greater of one quarter of an inch or three radiating element widths and is parallel to the printed circuit board.

The upper horizontal element 104 comprises a length that is approximately forty-five percent of the overall one-quarter wavelength of the folded loop antenna. A first portion of the upper horizontal element 104 serves as the antenna return point. The upper horizontal element 104 extends upward at a distance of three quarters of an inch away from a plane of a printed circuit board where the antenna is connected. A second portion of the upper horizontal element 104 extends parallel to the plane of the printed circuit board at a distance of one-eighth of a required wavelength and a third portion of the upper horizontal element extends downward towards the printed circuit board at a distance three-quarters of an inch from the second end of the upper horizontal element. The second vertical element 106 comprises a trace on the printed circuit board that connects the second end of the upper horizontal element 104 to the ground plane 112.

A key aspect of all embodiments of the antenna is that the ground plane 112 does not have to be continuous. That is, components can be placed on the printed circuit board within the minimum ground plane 112 area. Traces can be run without impact to the antenna performance characteristics as long as a nearly continuous ground plane 112 can be stitched together by using a conductive material situated upon differing printed board layers. Therefore, half of the ground plane 112 can be situated on the top of the circuit board and the other half on the bottom of the circuit board as long as the two ground planes 112 are in contact in order to produce a good RF connection between both sides. This aspect allows for the implementation of a sizable ground plane 112 at a low cost.

Flat Metal Stock Folded Loop Antenna

The flat metal embodiment of the folded loop antenna may be fabricated from a variety of metals including, but not limited to, brass and tinned brass. The antenna profile is lower relative to the printed circuit board than the wire embodiment. This aspect of the flat metal antenna embodiment provides significant mechanical stability. Further, a characteristic of the flat metal embodiment is a reduction in the loss of power within the antenna.

This embodiment of the antenna has a longer horizontal dimension since the height above a printed circuit board is lowered and the overall length of the antenna is still one-fourth wavelength. The increased surface area of the antenna reduces the loss in the antenna, thus indicating that the radio frequency waves propagate on or near the surface of the antenna; this occurrence is commonly referred to as a "skin effect."

The flat metal embodiment of the antenna element is of a rectangular parallelepiped shape and has a length that is approximately one-sixth of a wavelength at a required frequency, a height of approximately one-quarter inch, a width of approximately one-quarter inch and a radiating element width that is one-one hundredth of a wavelength. The radiating elements are configured so as to position the flat stock surface parallel to a printed circuit board that the antenna is mounted on. The length of the vertical trace 106 extends from the upper horizontal element 104 to the ground plane 112. Further, the proximity of the ground plane 112 at a loop-end varies the bandwidth of the antenna by changing the capacitive loading on the loop-end of the antenna. Further, changing the capacitive loading on the loop-end of the antenna varies the bandwidth of the antenna; this is accomplished by varying the proximity of the ground plane 112 at a loop end.

Printed Circuit Folded Loop Antenna

The printed circuit embodiment of the folded loop antenna is printed directly on a printed circuit board. The printed circuit may be fabricated from a variety of conductive materials; present embodiments may be fabricated from tin-plated copper printed on the circuit board to comprise the frame of the antenna. The horizontal length of the printed antenna is longer than those of the wire and flat metal embodiments of the antenna. The reason being is that the height of the antenna above the printed circuit board is reduced but the length of the antenna remains at approximately one-fourth wavelength.

The printed folded loop embodiment of the antenna is of a significantly rectangular shape and has a length that is approximately one-sixth of a wavelength at a required frequency, a width of approximately one-quarter inch and a radiating element line-width that is one-one hundred and fiftieth of a wavelength.

Figure 2:
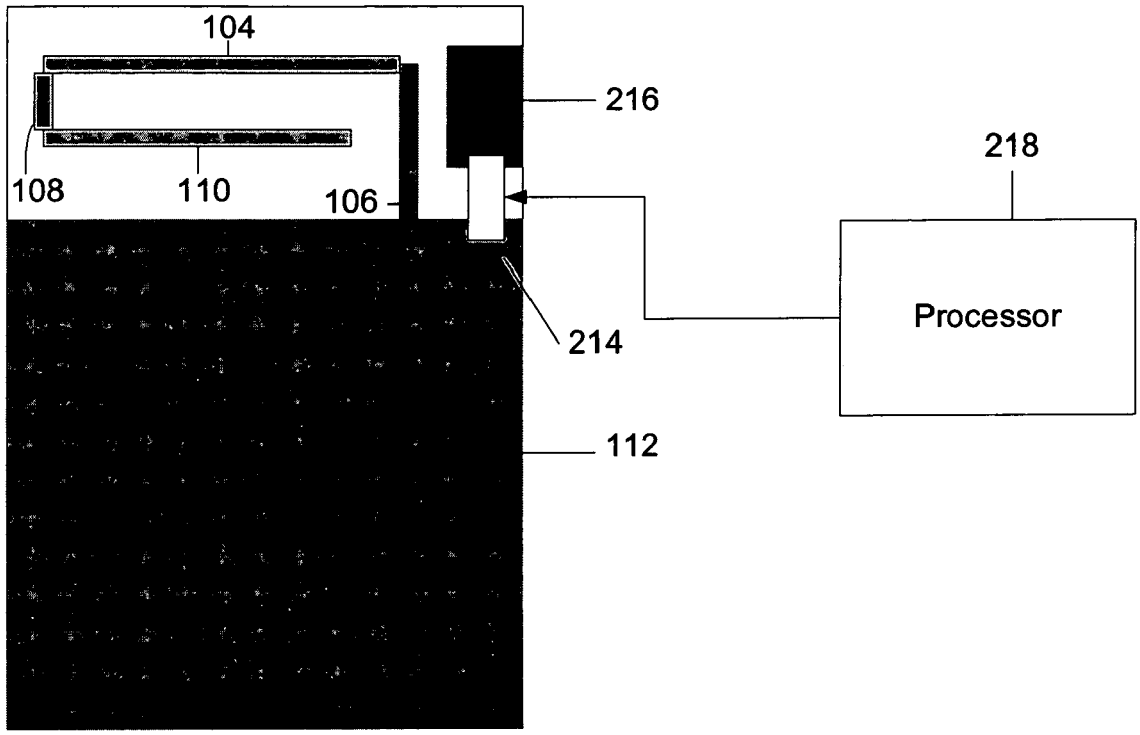
FIG. 2 is a diagram that relates to embodiments of the present invention that are implemented in conjunction with a processor.

FIG. 2 illustrates a further embodiment of the present invention comprising an omni-directional, orthogonally propagating, one-quarter wavelength folded loop antenna system that is enabled with polarization diversity.

This embodiment of the present invention is implemented with the above-described printed folded loop antenna. It is important to define the parameters of the printed circuit folded loop antenna. As mentioned above, the overall length of the antenna is approximately one-fourth wavelength at a required frequency. The layout and proximity of the antenna to the ground plane 112 on the printed circuit board is key to the performance of the antenna. In addition, as mentioned above, minimum ground plane 112 size is also critical to the performance of the antenna.

The folded loop antenna comprises an upper horizontal 104, a vertical 108, and a lower horizontal antenna 110 element. The ground plane 112 is in contact with the folded loop antenna, wherein the ground plane has a minimum length of three-sixteenths of a required wavelength. The ground plane 112 further comprises a vertical trace 106 that is in contact with the upper horizontal antenna element 104, the vertical trace 106 serving as an antenna return. A conductive plane 216 is situated in proximity to the loop antenna, wherein the conductive plane 216 is electrically isolated from the ground plane 112 and the folded loop antenna.

As illustrated in FIG. 2, a minimum of one-half inch of continuous conductive plane 216 is provided to the right side of the antenna. The continuous conductive plane 216 has a length that extends the approximate length from the upper horizontal element to the lower horizontal element. By placing the continuous conductive plane 216 in proximity to the antenna, the polarization of the antenna will rotate 90 degrees.

Further, the polarization of the antenna can be controlled by electronically switching the polarization of the antenna. This aspect of the invention is accomplished by attaching a semiconductor device 214 to the one-half inch of continuous conductive plane 216 (which is electrically isolated from the ground plane 112). The semiconductor device 214 can comprise a transistor, diode, or other similarly functioning electronically controlled switch.

For example, the collector of a NPN transistor is attached to the one-half inch continuous conductive plane 216 segment, and the emitter of the NPN transistor is attached to the ground of a circuit. When the base of the NPN transistor is turned on and off the result is that the segment of continuous conductive plane 216 will alternate between a conductive state, and thus being connected to ground, and being electrically isolated.

Figure 2A:
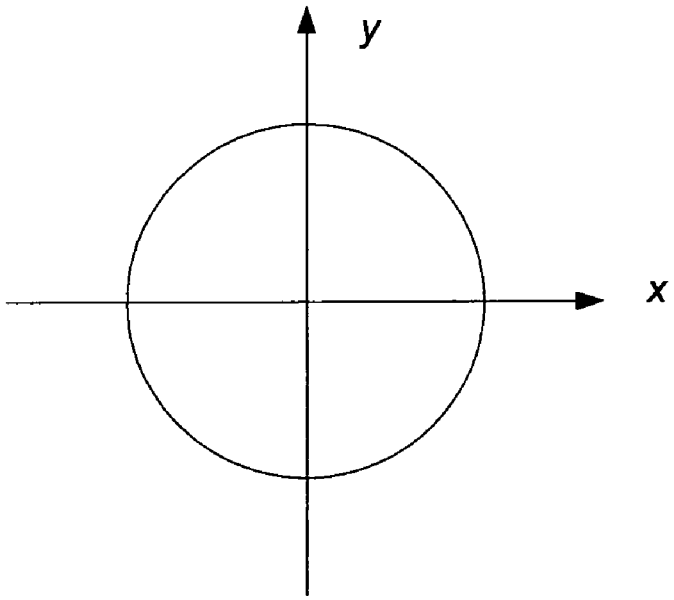
FIGS. 2A–2D are diagrams illustrating the azimuth and elevation antenna patterns that relate to embodiments of the present invention.
Figure 2B:
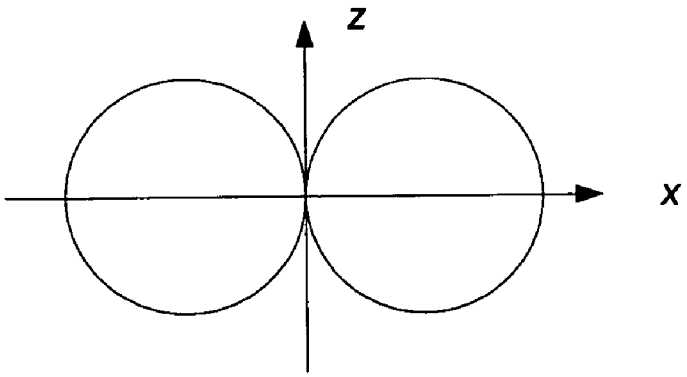
Figure 2C:
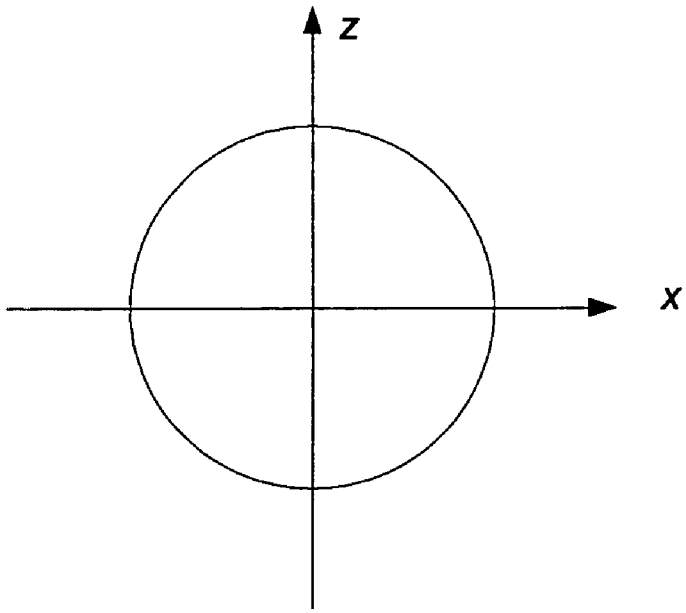
Figure 2D:
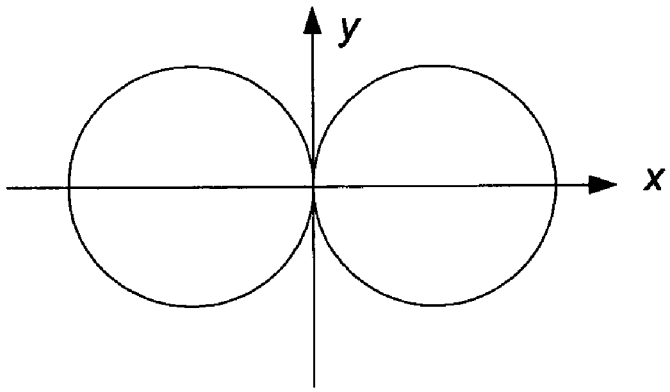

When the semiconductor device 214 is electrically activated the conductive plane 216 is in electrical contact with the ground plane 112 and the antenna operates as a horizontally polarized antenna. The azimuth and elevation polarization patterns of the antenna when the semiconductor 214 is conducting are illustrated in FIGS. 2C and 2D. When the semiconductor device 214 is not electrically activated the antenna operates as a vertically polarized antenna. The azimuth and elevation polarization patterns of the antenna when the semiconductor 214 is not conducting are illustrated in FIGS. 2A and 2B.

A processor 218 is used to control the switching of the semiconductor device 214 in order to synchronize the change in polarization with transmitted and/or received messages. Further, the processor 218 can assist in selecting a preferred polarization based upon the strength of a received signal or other predetermined criteria.

A yet further embodiment of the present invention comprises an omni-directional, orthogonally propagating, one-quarter wavelength folded loop antenna enabled with selectable secondary resonance frequency and 10 dB return loss bandwidth. This embodiment of the antenna comprises a printed folded loop antenna that is fabricated from a conductive medium.

The printed folded loop antenna has an upper horizontal 104, a vertical 108, and a lower horizontal 110 antenna element, each comprising a first and second end. The antenna has an overall length that is approximately one-fourth of a wavelength at a required frequency and a line width of one-one hundred and fiftieth of a wavelength. A ground plane 112 is in contact with the printed folded loop antenna, wherein the ground plane 112 has a minimum length of three-sixteenths of a required wavelength. A vertical trace 106 is in contact with the upper horizontal antenna element 104, the vertical trace 106 does not to exceed two radiating elements in width and serves as an antenna return.

The line width of the second end of the lower horizontal element 110 is increased to two and one half times an original line width equally about a centerline. The length of the wider line determines one degree of control on a secondary resonance frequency and an effective 10dB return loss bandwidth.

The line width of the first end of the upper horizontal element 104 is increased to two and one half times the width of the original line width and is added askew the centerline so as to begin at an uppermost edge of the upper horizontal element 104 and extend downward toward the ground plane 112. The length of this line provides a second degree of control on a secondary resonance frequency and an effective 10 dB return loss bandwidth. Further, the distance between an antenna feed element of the lower horizontal element 110 and the antenna return element 106 connecting the return to ground, provides a third degree of control on a secondary resonance frequency and an effective 10 dB return loss bandwidth.

It will be apparent to those skilled in the art that various modifications and variations can be made in the present invention without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed:

1. An omni-directional, orthogonally propagating, one-quarter wavelength folded loop antenna system enabled with polarization diversity, comprising:

a folded loop antenna fabricated from a conductive medium, the folded loop antenna comprising an upper horizontal, a lower horizontal and a vertical antenna element, wherein the antenna has an overall length that is approximately one-fourth a wavelength at a required frequency;

a ground plane in contact with the folded loop antenna, wherein the ground plane has a minimum length of three-sixteenths of a required wavelength and further comprises a vertical trace in contact with the upper horizontal antenna element, the vertical trace serving as an antenna return;

a conductive plane situated in proximity to the folded loop antenna, located near an antenna feed and the antenna return of the folded loop antenna, wherein the conductive substance is electrically isolated from the ground plane and the folded loop antenna; the conductive plane being a minimum of one-half inch wide and having a length that extends approximately the length from the upper horizontal element to the lower horizontal element;

a semiconductor device in electrical contact with the ground plane and the conductive plane; and a processing means in electrical communication with the semiconductor device, wherein the processing means controls the activation and deactivation of the semiconducting device.

2. The antenna of claim 1, wherein when the semiconductor device is electrically activated, the conductive plane is in electrical contact with the ground plane, thus enabling the antenna to operate as a horizontally polarized antenna.

3. The antenna of claim 2, wherein when the semiconductor device is not electrically activated the conductive plane is not in electrical contact with the ground plane and the antenna operates as a vertically polarized antenna.

4. The system of claim 3, wherein the processing means determines the polarization of the antenna based upon predetermined criteria.

* * * * *